US009002247B2

(12) United States Patent
Watatani

(10) Patent No.: US 9,002,247 B2
(45) Date of Patent: Apr. 7, 2015

(54) FIXING UNIT, IMAGE FORMING APPARATUS INCLUDING THE SAME, AND METHOD FOR SEPARATING RECORDING MEDIUM

(71) Applicant: Tomohiro Watatani, Osaka (JP)

(72) Inventor: Tomohiro Watatani, Osaka (JP)

(73) Assignee: KYOCERA Document Solutions Inc. (JP)

( * ) Notice: Subject to any disclaimer, the term of this patent is extended or adjusted under 35 U.S.C. 154(b) by 158 days.

(21) Appl. No.: 13/691,244

(22) Filed: Nov. 30, 2012

(65) Prior Publication Data

US 2013/0136510 A1 May 30, 2013

(30) Foreign Application Priority Data

Nov. 30, 2011 (JP) ..... 2011-261199

(51) Int. Cl.
*G03G 15/20* (2006.01)

(52) U.S. Cl.
CPC ..... *G03G 15/2085* (2013.01); *G03G 15/2028* (2013.01)

(58) Field of Classification Search
CPC ..... G03G 15/2028; G03G 15/2085; G03G 2215/00573
See application file for complete search history.

(56) References Cited

U.S. PATENT DOCUMENTS

| | | | | |
|---|---|---|---|---|
| 4,951,936 | A * | 8/1990 | Taniyama | 271/307 |
| 2002/0028089 | A1 | 3/2002 | Yoneda et al. | |
| 2006/0008282 | A1 | 1/2006 | Aratachi et al. | |
| 2007/0223975 | A1 * | 9/2007 | Yoshida | 399/323 |

FOREIGN PATENT DOCUMENTS

| | | |
|---|---|---|
| JP | 2002-116653 | 4/2002 |
| JP | 2006-030274 | 2/2006 |

* cited by examiner

*Primary Examiner* — Clayton E LaBalle
*Assistant Examiner* — Victor Verbitsky
(74) *Attorney, Agent, or Firm* — McDonnell Boehnen Hulbert & Berghoff LLP

(57) ABSTRACT

A fixing unit includes a heating member, a pressing member, a casing, a separating member, and an urging member. The separating member has a separation claw and a rotating unit. The urging member urges the separation claw toward the surface of the heating member. The rotating unit has an engaging portion and guide surfaces opposing at an interval smaller than that of the engaging portion. The supporting portion includes an engagement supporting portion that rotatably engages the engaging portion and an insertion opening. The separating member rotates to retract guide surfaces from a position facing the inner wall surfaces of the insertion opening. The guide surfaces oppose the inner wall surfaces of the insertion opening to bring the engaging portion to the engagement supporting portion and thereafter mounting the heating member on the casing.

10 Claims, 9 Drawing Sheets

FIXING UNIT, IMAGE FORMING APPARATUS INCLUDING THE SAME, AND METHOD FOR SEPARATING RECORDING MEDIUM

INCORPORATION BY REFERENCE

This application is based upon and claims the benefit of priority from the corresponding Japanese Patent application No. 2011-261199, filed Nov. 30, 2011, the entire contents of which is incorporated herein by reference.

BACKGROUND

Unless otherwise indicated herein, the description in this section is not prior art to the claims in this application and is not admitted to be prior art by inclusion in this section. The present disclosure relates to a fixing unit for use in image forming apparatuses, possibly including copying machines, printers, facsimile machines, and multifunction peripherals, among other possibilities. In particular, the present disclosure relates to an image forming apparatus including a fixing unit that separates a recording medium from the surface of a heating member.

In some embodiments, a fixing unit may include an unfixed toner image between a heating member and a pressing member. A recording medium may be fed to the fixing unit such that the heating member fuses toner on the recording medium by a heating action. In addition, the pressing member may fix the fused toner image onto the recording medium by a pressing action.

In some instances, this fixing unit may sometimes have a separating member with a separation claw to prevent the recording medium from winding around the heating member. The separating member may be mounted to the casing of the fixing unit in such a manner that it opposes (e.g., prevents, averts, and/or stops) the surface of the recording medium from coming into contact with the heating member, possibly while keeping a predetermined distance between them.

An example of the fixing unit includes a first casing and a second casing. A heating roller and a pressure roller are rotatably fitted (e.g., rotated and fitted) in the first casing. A separating member is rotatably fitted in the second casing. The separating member includes a separation claw and a rotating shaft.

A spring member may contract to "urge" (e.g., move, pull, and/or lower) the separation claw toward the surface of the heating roller provided between the separating member and the second casing. The second casing has a slot and a bearing disposed inside the slot. The rotating shaft of the separating member has a second shaft having a flat portion and an arc portion. The outer circumference of the rotating shaft has a protruding portion with a curvature. The second casing has a diagonal rib which opposes the protruding portion by making contact with it when the rotating shaft is rotated against the urging (e.g., contracting) force of the spring member. When the separating member is to be mounted to the second casing, the flat portion of the second shaft is inserted into the opposing slot of the second casing until the arc portion of the second shaft reaches the bearing portion of the second casing. The rotating shaft may be rotated with the arc portion of the second shaft on the bearing portion of the second casing. The rotating shaft may be rotated until the protruding portion of the rotating shaft makes contact with the diagonal rib of the second casing. This allows the rotating shaft to rotate in a predetermined range until the protruding portion makes contact with the diagonal rib.

However, the rotational state of the rotating shaft may be controlled by the spring member and urged toward the diagonal rib. In some instances, the second casing is mounted on the first casing and the rotating shaft is rotated against the contracting force of the spring member. This rotation may cause the protruding portion of the rotating shaft to be separated from the diagonal rib but in a predetermined range such that the separating member may be urged to the surface of the heating roller. As such, the separating member may be mounted so as to come in contact with the surface of the heating roller.

For the fixing unit described above, it is necessary to include the protruding portion on the rotating shaft of the separating member and to utilize the diagonal rib on the second casing. In some instances, such implementations may complicate the configurations of the separating member and the second casing. Furthermore, the rotating shaft of the separating member has to be forced into rotating until the protruding portion of the rotating shaft makes contact with the diagonal rib of the second casing. In addition, when the second casing fitted is mounted to the first casing fitted, the position of the separating member relative to the surface of the heating roller may become unstable, which makes it difficult to mount the separating member. Thus, the improvements described herein provide enhanced solutions involving engineering robustness and mechanical efficiency.

SUMMARY

A fixing unit according to an embodiment of the present disclosure is provided that includes a heating member, a pressing member, a casing, a separating member, and an urging member. The heating member is heated by a heat source. The pressing member is pressed against with the heating member to form a nip so as to fuse an unfixed toner image on a recording medium subjected to a fixing process. The casing includes a supporting member, where the casing rotatably supports the pressing member and the heating member. The separating member includes a separation claw that separates the recording medium from a surface of the heating member by making contact with the surface of the heating member. A rotating unit rotates the separation claw such that the separation claw makes contact with the surface of the heating member. The rotating unit includes an engaging portion and guide surfaces, where at least part of the engaging portion is cylindrical in shape and an interval between the guide surfaces is smaller than a diameter of the engaging portion. An engagement supporting portion rotatably engages the engaging portion. An insertion opening extends toward the engagement supporting portion at an interval smaller than the diameter of engaging portion and larger than the interval between the guide surfaces. The separating member rotates and retracts the guide surfaces from a position facing inner wall surfaces of the insertion opening by inserting the engaging portion into the insertion opening. The guide surfaces are opposed to the inner wall surfaces of the insertion opening to move the engaging portion to the engagement supporting portion. The heating member is mounted on the casing.

An image forming apparatus according to another embodiment of the present disclosure includes a heating member, a pressing member, a casing, a separating member, and an urging member. The heating member is heated by a heat source. The pressing member is pressed against with the heating member to form a nip so as to fuse an unfixed toner image on a recording medium subjected to a fixing process. The casing includes a supporting member, where the casing rotatably supports the pressing member and the heating member. The separating member includes a separation claw that separates the recording medium from a surface of the heating member by making contact with the surface of the heating member. A rotating unit rotates the separation claw such that the separation claw makes contact with the surface of the heating member. The rotating unit includes an engaging portion and guide surfaces, where at least part of the engaging portion is cylindrical in shape and an interval between the guide surfaces is smaller than a diameter of the engaging portion. An engagement supporting portion rotatably engages the engaging portion. An insertion opening extends toward the engagement supporting portion at an interval smaller than the diameter of engaging portion and larger than the interval between the guide surfaces. The separating member rotates and retracts the guide surfaces from a position facing inner wall surfaces of the insertion opening by inserting the engaging portion into the insertion opening. The guide surfaces opposed to the inner wall surfaces of the insertion opening to move the engaging portion to the engagement supporting portion. The heating member is mounted on the casing.

A method according to another embodiment of the present disclosure includes a fixing unit rotating a pressing member and a heating member, where the pressing member and the heating member are rotatably supported in a casing of the fixing unit. The fixing unit presses the pressing member against the heating member to form a nip and sending a recording medium through the nip to fuse an unfixed toner image on the recording medium. The fixing unit moves a rotating unit such that a separating member rotates towards the heating member, where the rotating unit moves in response to movement of an urging member. The fixing unit separates the recording medium from a surface of the heating member using a separation claw, where the separation claw prevents the recording medium from winding around the heating member.

These as well as other aspects, advantages, and alternatives, will become apparent to those of ordinary skill in the art by reading the following brief description, with reference where appropriate to the accompanying drawings.

DETAILED DESCRIPTION

Although an embodiment of the present disclosure will be described herein with reference to the drawings, the present disclosure is not limited to these embodiments as other implementations are also possible. Applications of the disclosure and terms presented here are not limited thereto.

Figure 1:
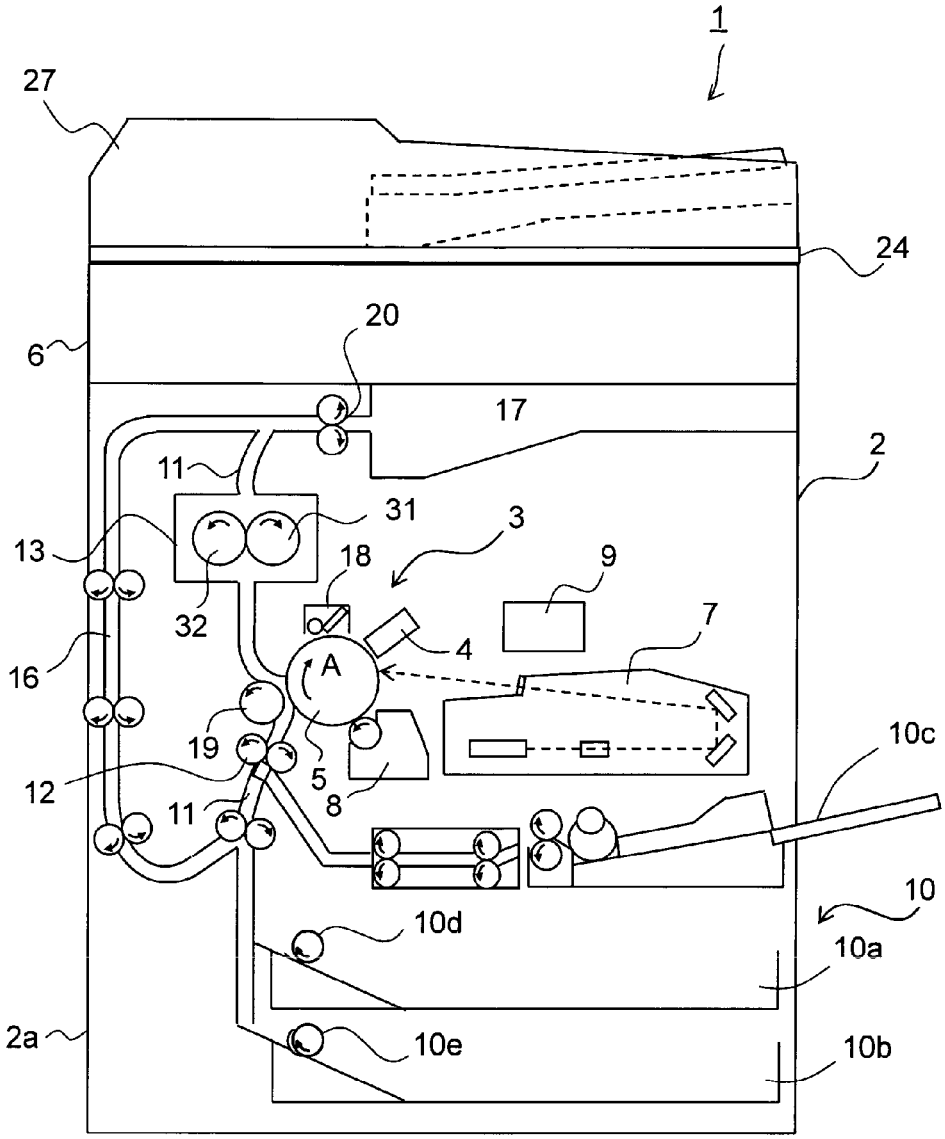
FIG. 1 a diagram showing, in outline, the overall configuration of an image forming apparatus equipped with a fixing unit, according to an example embodiment of the present disclosure.

FIG. 1 is a diagram showing the overall configuration of an internal-paper-output type image forming apparatus. An image forming apparatus 1 has a cassette-type paper feeding unit 10 at the lower part thereof. The paper feeding unit 10 has two upper and lower paper cassettes 10*a* and 10*b*. The paper cassettes 10*a* and 10*b* accommodate stacked sheets of paper before printing. The sheets of paper accommodated in the paper cassettes 10*a* and 10*b* are fed out one by one with a paper pickup roller 10*d* and 10*e*, respectively. The fed out paper is sent to a paper conveying path 11.

A manual paper feeding tray 10*c* is positioned on the right side of the image forming apparatus 1. The manual paper feeding tray 10*c* can also accommodate different sizes of paper from those of the paper cassettes 10*a* and 10*b*. The paper placed in the manual paper feeding tray 10*c* is fed out to the paper conveying path 11.

The paper conveying path 11 extends in a vertical direction of the apparatus main body 2 on the left side of the paper feeding unit 10. The paper fed out from the paper feeding unit 10 is conveyed to a registration roller pair 12 at the upper part of the paper conveying path 11. The registration roller pair 12 feeds the paper toward an image forming unit 3 in synchronization with the timing at which a toner image is transferred to the paper.

A document reader 6 is located at the upper part of the image forming apparatus 1. A platen (document holder) 24 can be opened and positioned on the upper surface of the document reader 6. Furthermore, a document conveying unit 27 is mounted on the platen 24. When documents are to be copied, the documents placed on the document conveying unit 27 are separated one by one and are fed to the document reader, where image data is read from the documents.

The image forming unit 3 is positioned substantially at the center of the image forming apparatus 1. The image forming unit 3 includes a photoreceptor 5 serving as an image bearing member, and furthermore, a charging unit 4, an exposing unit 7, a developing unit 8, a transfer roller 19, and a cleaning unit 18 around the photoreceptor 5 in this order along the rotating direction thereof (in the direction of arrow A in FIG. 1). Toner is supplied to the developing unit 8 from a toner container 9. The cleaning unit 18 has a cleaning member, such as a blade, a brush, or a polishing roller, strips off toner remaining on the surface of the photoreceptor 5 with the cleaning member, and recovers it.

When the surface of the photoreceptor 5 is uniformly charged at a predetermined polarity and potential by the charging unit 4, the exposing unit 7 forms a static latent image of the document image on the photoreceptor 5 on the basis of the document image data read by the document reader 6.

The developing unit 8 supplies the charged toner to the surface of the photoreceptor 5 and develops the static latent image on the photoreceptor 5 to form a toner image. The toner image on the photoreceptor 5 is transferred onto paper by the transfer roller 19. The paper to which the toner image is transferred is conveyed to the fixing unit 13 located at the upper part of the paper conveying path 11. After the toner image is transferred onto the paper, toner remaining on the surface of the photoreceptor 5 is cleaned off and recovered by the cleaning unit 18, and residual electrical charge on the surface of the photoreceptor 5 is removed by a static eliminator (not shown).

The fixing unit 13 includes a heating roller 31 and a pressure roller 32 for applying heat and pressure, respectively, to the paper on which the toner image is transferred. As such, the heating roller 31 and the pressure roller 32 fix the toner image on the paper by thermal fusion. The paper on which the toner image is fixed is conveyed to the upper right through the paper conveying path 11 and is output to an internal paper output unit 17 serving as an output section by the output roller pair 20.

A reverse conveying path 16 branches from the paper conveying path 11 between the fixing unit 13 and the output roller pair 20. The reverse conveying path 16 is used, after the toner image is fixed to one of the surfaces of the paper, to form the toner image on the other surface of the paper as needed. The reverse conveying path 16 covers the periphery of the fixing unit 13 from above the fixing unit 13, extends downward between the paper conveying path 11 and a side 2*a* of the apparatus main body 2, and merges with the paper conveying path 11 in the vicinity of the registration roller pair 12. For two-sided printing, while the paper in which the toner image is fixed to one surface is output to the internal paper output unit 17, the output roller pair 20 is reversed at the timing at which the trailing end of the paper passes through the branch point of the paper conveying path 11 and the reverse conveying path 16. This causes the paper to be switched back to the reverse conveying path 16, with the print surface thereof reversed inside out, and to be conveyed again from the reverse conveying path 16 to the registration roller pair 12 in the paper conveying path 11. Thereafter, when the toner image is transferred also onto the other side of the paper by the image forming unit 3, the paper is subjected to a fixing process by the fixing unit 13 and is output to the internal paper output unit 17.

Figure 2:
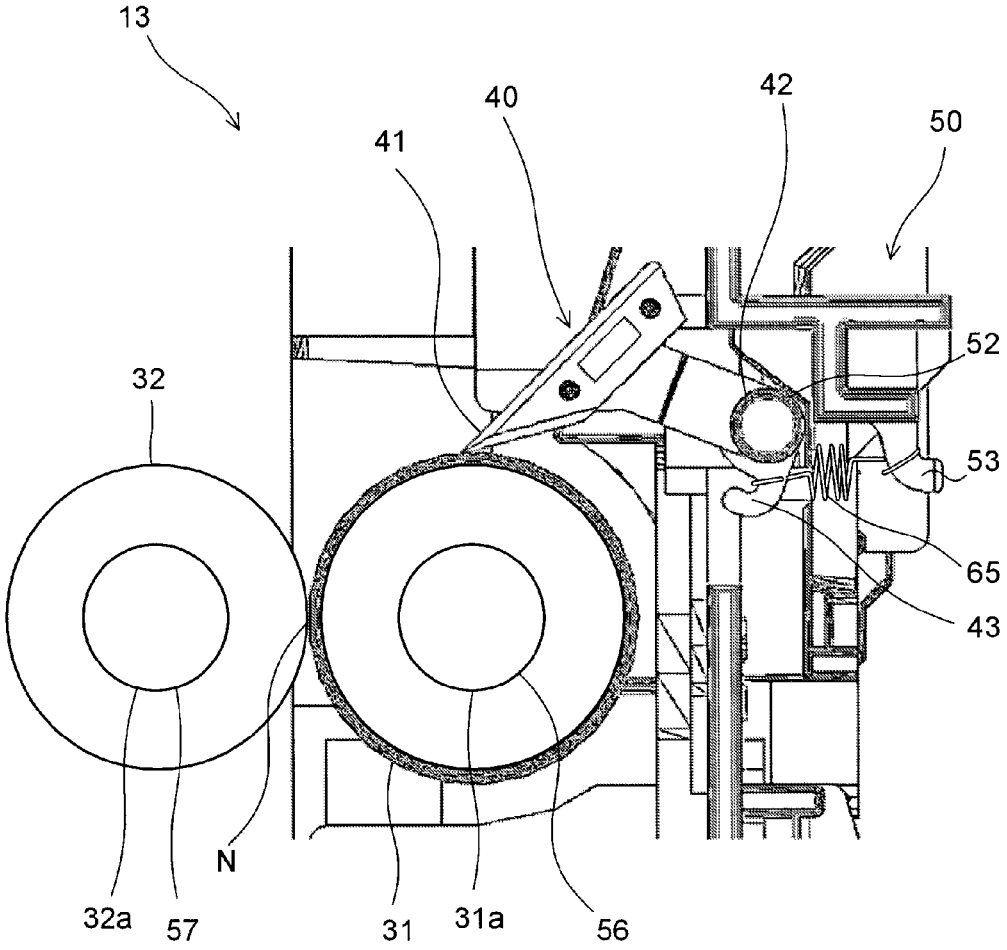
FIG. 2 is a side view showing the internal configuration of the fixing unit, according to an example embodiment.

FIG. 2 is a side view showing the internal configuration of the fixing unit 13 used in the image forming apparatus 1 described above. The fixing unit 13 employs a roller fixing system and includes the heating roller 31 serving as a heating member, the pressure roller 32 serving as a pressing member, separating members 40, and a casing 50. The heating roller 31, the pressure roller 32, and the separating members 40 are supported by the casing 50.

The heating roller 31 is formed by coating a cylindrical core made of metal having high thermal conductivity, such as aluminum and iron, with a fluoroplastic coat or tube. The core of the heating roller 31 accommodates a heater serving as a heat source (not shown), such as a halogen lamp and a xenon lamp. The heating roller 31 is heated to a predetermined temperature by the heater.

The heating roller 31 is rotatably supported by the casing 50 (e.g., supported by casing 50 such that it can rotate). A pair of rotation shafts 31*a* are provided at both ends in the axial direction of the heating roller 31. The rotation shafts 31*a* rotatably engage (e.g., rotate) with bearing portions formed at the casing 50.

The pressure roller 32 is made by forming an elastic layer, such as silicone rubber, around a cylindrical base material made of synthetic resin, metal, or another material. In addition, the surface of the elastic layer may be coated with resin having high releasing capabilities, such as fluoroplastic.

The pressure roller 32 is rotatably supported by the casing 50 (e.g., supported by casing 50 such that it can rotate). A pair of rotation shafts 32*a* are provided at both ends in the axial direction of the pressure roller 32. The rotation shafts 32*a* rotatably engage with bearing portions formed at the casing 50. The pressure roller 32 is in contact with the heating roller 31 while applying a predetermined pressure on roller 31. When the pressure roller 32 is rotated by a driving source, such as a motor, the heating roller 31 is also rotated together therewith. Alternatively, it is also possible that the heating roller 31 is rotated by a driving source, and the pressure roller 32 is rotated as the heating roller 31 rotates.

A nip N is formed at a portion where the heating roller 31 and the pressure roller 32 are in contact while rotating in opposite directions. Paper is conveyed from the upstream side in the paper conveying direction (lower part in FIG. 2) to the nip N, where the paper is heated and pressurized by the heating roller 31 and the pressure roller 32, respectively. As such, the particle toner on the paper is fixed by thermal fusion.

The separating members 40 separate the paper subjected to the fixing process from the surface of the heating roller 31. The separating members 40 are arranged side by side at a plurality of locations in the axial direction of the heating roller 31. The separating members 40 each have a separation claw 41, a rotating unit 42, and a spring hook 43 (hook).

The separation claws 41 are positioned downstream of the nip N in the rotating direction of the heating roller 31 (clockwise in FIG. 2). The tips of the separation claws 41 make contact with the surface of the heating roller 31. Using the separation claws 41, the paper subjected to the fixing process at the nip N is separated from the surface of the heating roller 31 and is thereafter conveyed downstream in the paper conveying direction (upward in FIG. 2).

The rotating unit 42 rotates the separation claw 41 in a manner to bring it in and out of contact with the surface of the heating roller 31. Further, rotating unit 42 is rotatably supported by a pair of supporting portions 52 provided at the casing 50.

The spring hook 43 is provided at the opposite side from the separation claw 41 with respect to the rotating unit 42 and secures a hook portion at one end of a spring member 65 serving as an urging member. The spring member 65 is formed using a tensile coil spring. A hook portion at the other end of the spring member 65 is secured using a protruding piece 53 provided at the casing 50. The separating members 40 are each urged by the spring member 65 counterclockwise in FIG. 2 around the rotating unit 42, which brings the separation claws 41 into contact with the surface of the heating roller 31. As such, the paper that attaches to the surface of the heating roller 31 is separated from the surface of the heating roller 31 using separation claws 41.

Figure 3:
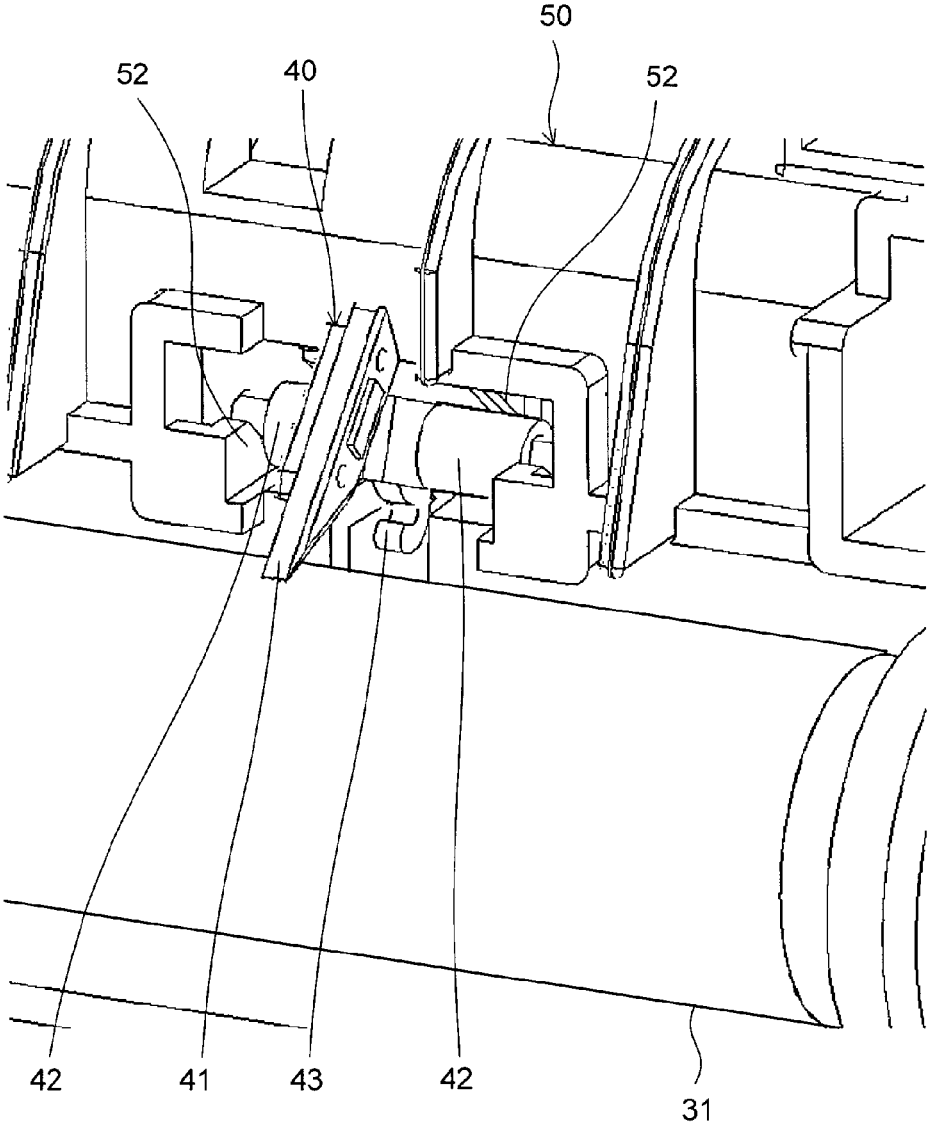
FIG. 3 is a view showing a configuration for supporting a rotating unit of a separating member with a supporting portion of a casing, according to an example embodiment.
Figure 4:
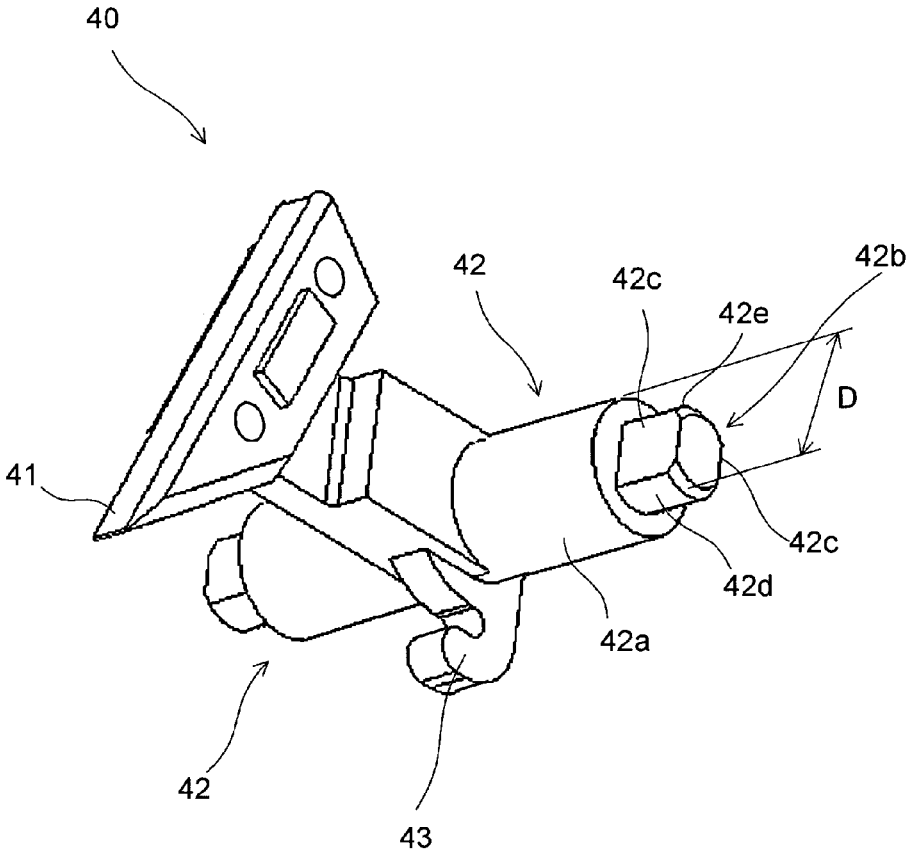
FIG. 4 is a view showing the separating member, according to an example embodiment.
Figure 5:
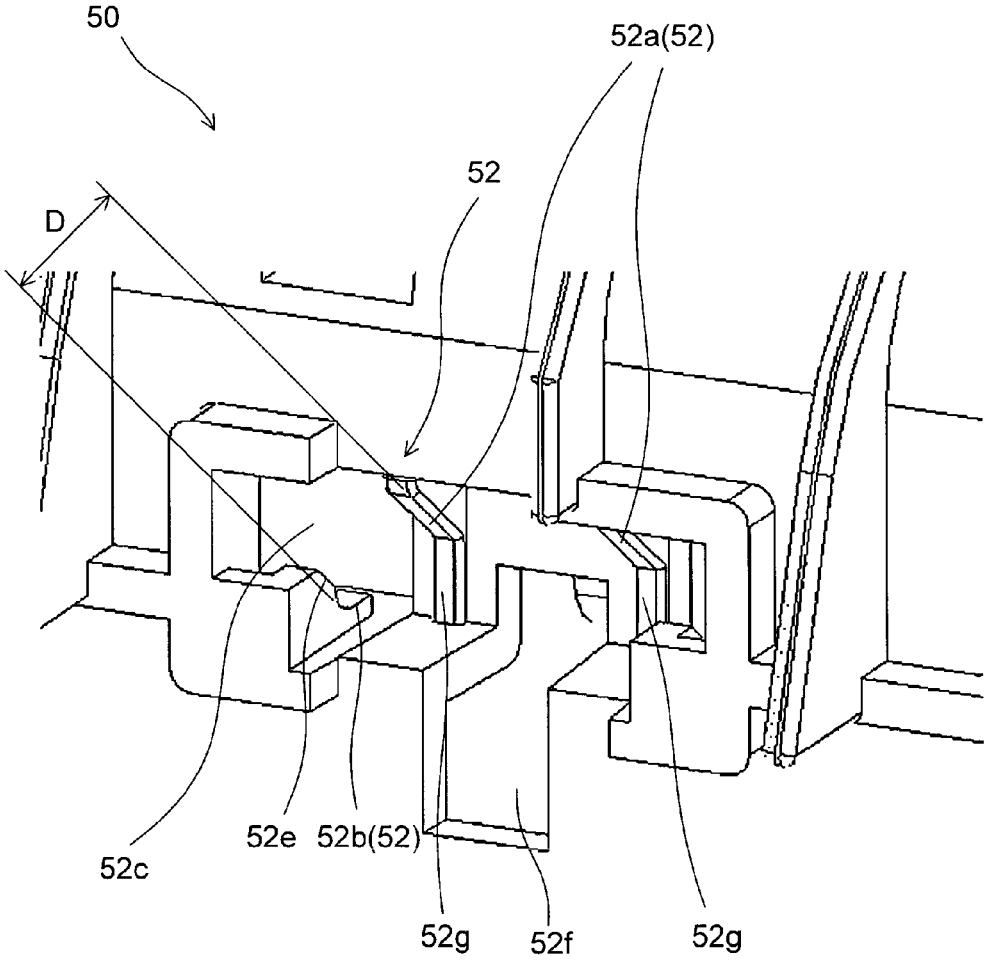
FIG. 5 is a view showing the supporting portion of the casing, according to an example embodiment.

Referring to FIGS. 3 to 5, a configuration for supporting the rotating unit 42 for the separating member 40 with the supporting portions 52 of the casing 50 will be described. FIG. 3 is a perspective view showing the configuration for supporting the rotating unit 42 with the supporting portions 52. FIG. 4 is a perspective view showing the configuration of the separating member 40. FIG. 5 is a perspective view showing the configuration of the supporting portions 52.

As shown in FIG. 3, the separating member 40 is provided with the separation claws 41 and the spring hook 43 substantially at the center of the rotating unit 42, with respect to the ends of rotating unit 42 in each axial direction.

The casing 50 has a space that accommodates the rotating unit 42 and the spring hook 43. The space accommodates the supporting portions 52 opposing the rotating unit 42. It is possible to insert the separating member 40 into the space in the casing 50 to mount the rotating unit 42 to the supporting portions 52 in a rotatable manner.

As shown in FIG. 4, the rotating unit 42 has a first shaft 42*a* and second shafts 42*b*. The first shaft 42*a* is provided by a cylindrical member extending from the base of the separation claw 41 toward the end of the cylindrical member in each axial direction. The second shafts 42*b* extend further from the first shaft 42*a* toward the end of the axial direction and each have a pair of opposing flat portions 42*c* and a pair of opposing arc portions 42*d* and 42*e*.

The pair of flat portions 42*c* each include a flat surface having a width smaller than the diameter of the first shaft 42*a* (the width in the direction perpendicular to the axial direction of the first shaft 42*a*). The pair of arc portions 42*d* and 42*e* each include an arc surface having an arc with a diameter smaller than the diameter of the first shaft 42*a*. The arc portion 42*d* is provided on the second shaft 42*b* so as to face in the orientation of the tip of the separation claw 41. The arc portion 42*e* is provided on the second shaft 42*b* so as to face in an opposite direction as compared to the tip of the separation claw 41. The pair of arc portions 42*d* and 42*e* may be combined to amount to an arc surface with the same diameter as that of the first shaft 42*a*.

The arc portion 42*d* and part of the outer circumferential surface of the first shaft 42*a* may provide for "an engaging portion." Referring back to FIGS. 2 and 3, the separating member 40 may be mounted to the casing 50. As such, the engaging portion may rotatably engage with respect to the supporting portions 52. The pair of flat portions 42*c* in FIG. 4 may be used as guide surfaces and may be configured to guide the rotating unit 42 toward the supporting portions 52.

As shown in FIG. 5, the supporting portions 52 of the casing 50 have a pair of first engagement supporting portions 52*a* and a pair of second engagement supporting portions 52*b* (the second engagement supporting portion 52*b* at the right in FIG. 5 is not shown due to the angle of casing 50 illustrated in the figure). The first engagement supporting portions 52*a* and the second engagement supporting portions 52*b* establish "an engagement supporting portion" that rotatably engages the rotating unit 42. The first engagement supporting portions 52*a* are slopes that decline downward from the insertion side toward contact surfaces 52*g*. The second engagement supporting portions 52*b* are positioned outside the first engagement supporting portions 52*a* of the supporting portion 52 (at both ends of the accommodation space for the rotating unit 42). In addition, the second engagement supporting portions 52*b* are each shaped with an arc having substantially the same diameter as those of the arc portions 42*d* and 42*e* of the second shaft 42*b*.

When the separating member 40 is mounted to the casing 50, the first shaft 42*a* (see FIG. 4) of the rotating unit 42 may engage with (and/or possibly rotate with respect to) the first engagement supporting portions 52*a*. In addition, the arc portions 42*d* (see FIG. 4) of the rotating unit 42 (the second shafts 42*b*) may engage with (and/or possibly rotate with respect to) the second engagement supporting portions 52*b* such that the rotating unit 42 is supported by the casing 50.

Accordingly, the first engagement supporting portions 52*a* and the second engagement supporting portions 52*b* may be separated at distance D shown in FIG. 5 in cross-sectional view in the axial direction of the rotating unit 42. The distance D is set to substantially the same width as the distance D between the arc portion 42*d* of the second shaft 42*b* and part of the outer circumferential surface of the first shaft 42*a* (see FIG. 4). It should be noted that the distance D in FIG. 4 and the distance D in FIG. 5 are substantially the same so that the engaging portion can rotate without making physical contact with the first engagement supporting portions 52*a* and the second engagement supporting portions 52*b*.

A wall surface 52*e* is provided in the vicinity of each second engagement supporting portion 52*b*. From the view provided in FIG. 5, the wall surface 52*e* is formed parallel to the first engagement supporting portion 52*a*. In some instances, the wall surface 52*e* and the wall surface of the first engagement supporting portion 52*a* may form a gap serving as an insertion opening 52*c*. The insertion opening 52*c* extends toward or past the first engagement supporting portion 52*a* and the second engagement supporting portion 52*b* (engagement supporting portion). In some instances, the insertion opening 52*c* may extend at a width smaller than the distance D to allow the second shaft 42*b* to be inserted therein. Further, in some instances, the second shaft 42*b* may be inserted with the pair of flat portions 42*c* (see FIG. 4) of the second shaft 42*b* opposed or closely aligning to the inner wall surfaces (guide surfaces) of the insertion opening 52*c*.

Contact surfaces 52*g* are formed below both of the first engagement supporting portions 52*a*. The contact surfaces 52*g* are vertical surfaces extending downward from the first engagement supporting portions 52*a*. When the separating member 40 is mounted to the casing 50, the outer circumferential surface of the first shaft 42*a* (see FIG. 4) may come into contact with the contact surface 52*g* together with the first engagement supporting portions 52*a*.

An opening 52*f* that opens downward is formed between the pair of first engagement supporting portions 52*a*. This opening 52*f* prevents physical contact from being made between the spring hook 43 of the separating member 40 (see FIG. 4) and the casing 50 when the separating member 40 rotates.

The separating member 40 is mounted to the casing 50 in the order of operations illustrated in FIGS. 6 to 9. FIGS. 6 to 9 are side views showing operations for mounting the separating member 40 to the casing 50.

Figure 6:
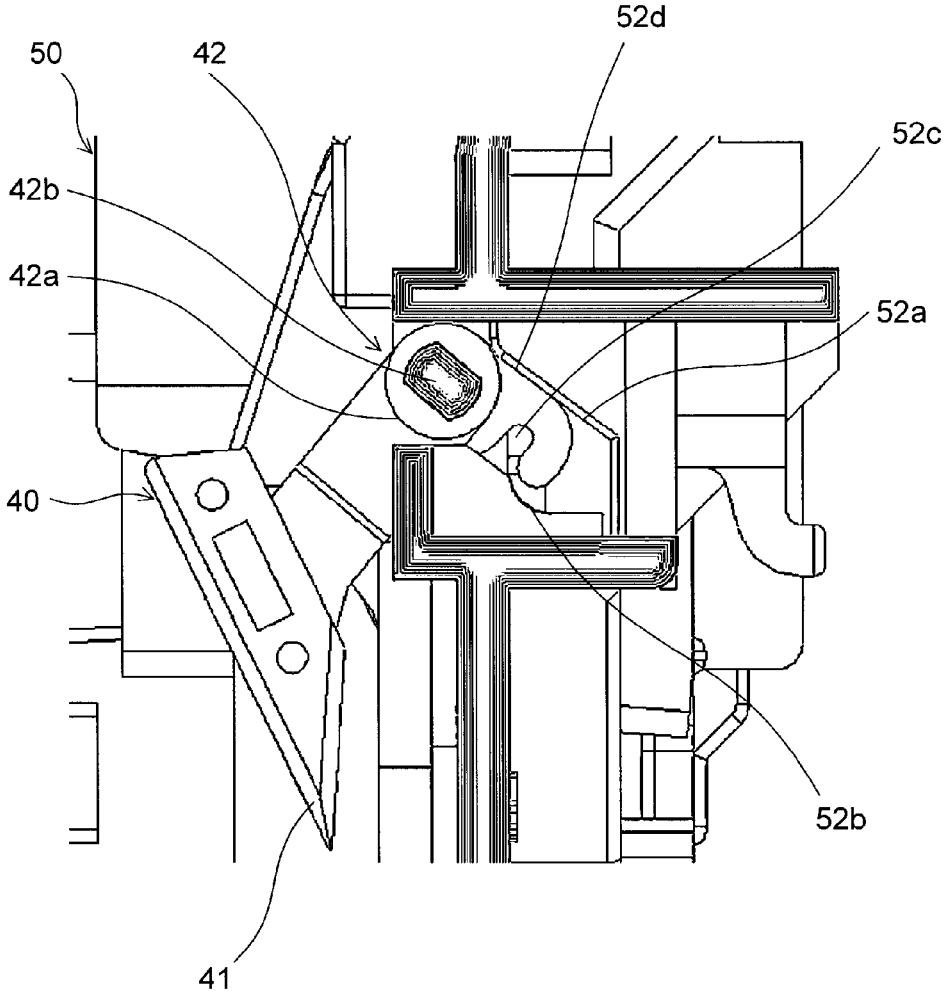
FIG. 6 is a side view showing a first process for mounting the separating member to the casing, according to an example embodiment.

As shown in FIG. 6, the movement of rotating unit 42 may be opposed or controlled by the inlet of the insertion opening 52*c* such that the separation claw 41 of the separating member 40 may be positioned downward toward the heating roller 31 (see FIG. 2). The two flat portions 42*c* of each second shaft 42*b* are opposed to the inner wall surfaces of the insertion opening 52*c*. From this state, the rotating unit 42 is inserted into the insertion opening 52*c*. When the rotating unit 42 is inserted, the flat portions 42*c* of each second shaft 42*b* move in the insertion opening 52*c* toward the first and second engagement supporting portions 52*a* and 52*b*, and the first shaft 42*a* moves toward the first and second engagement supporting portions 52*a* and 52*b* while maintaining contact with wall surfaces 52*d* extending from the first engagement supporting portions 52*a* to the insertion side. Since this configuration allows the rotating unit 42 to be inserted, with the first shaft 42*a* in contact with the wall surfaces 52*d*, the rotating unit 42 can be moved easily and reliably toward the first and second engagement supporting portions 52*a* and 52*b*.

Figure 7:
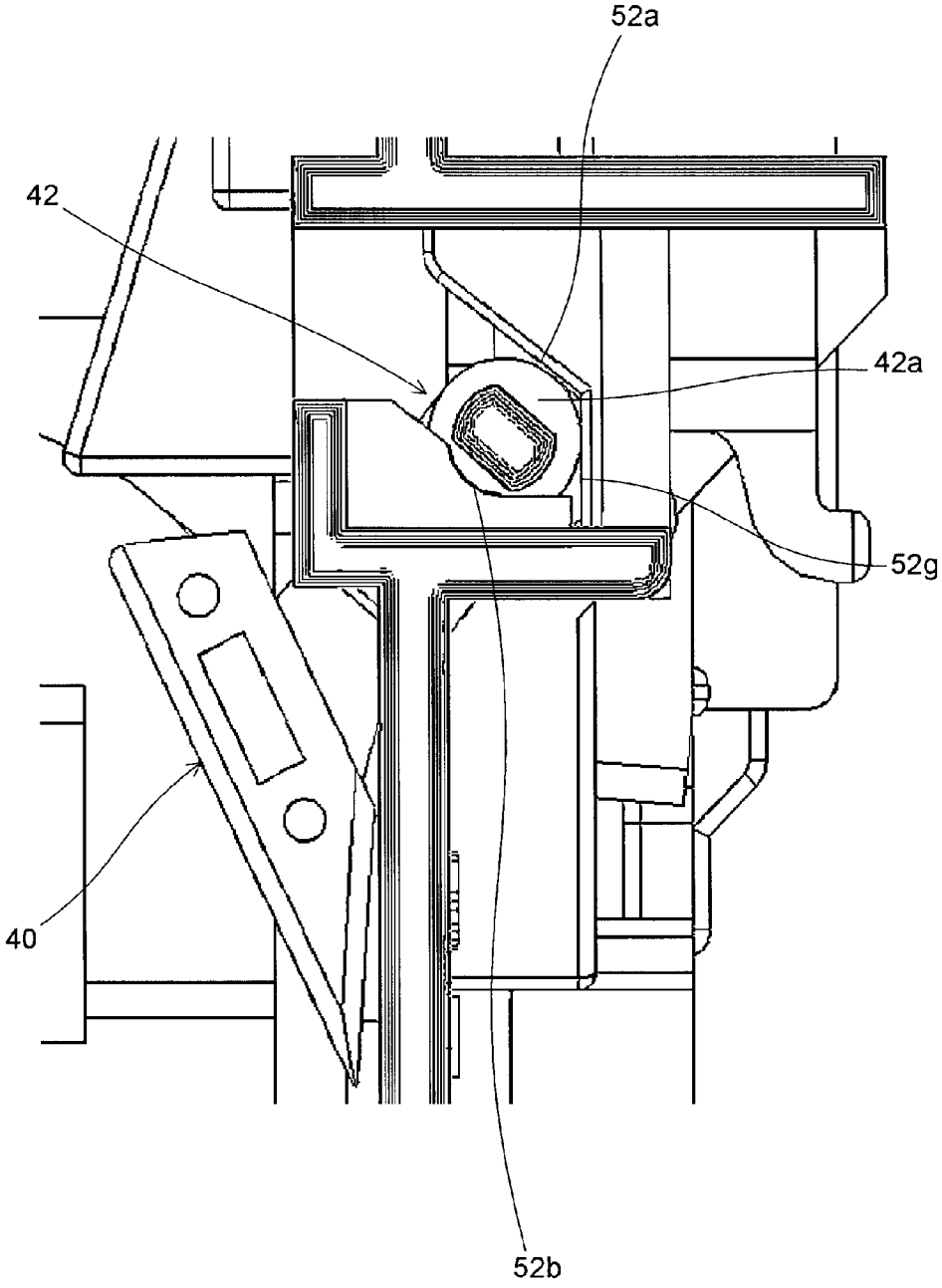
FIG. 7 is a side view showing a second process for mounting the separating member to the casing, according to an example embodiment.

As shown in FIG. 7, when the rotating unit 42 is inserted until the first shaft 42*a* comes into contact with the contact surfaces 52*g*, with the flat portions 42*c* of the second shafts 42*b* opposed to (e.g., closely aligned with) the inner wall surfaces of the insertion opening 52*c*, the rotating unit 42 reaches the first and second engagement supporting portions 52*a* and 52*b*. Next, as shown in FIG. 8, the separating member 40 is rotated clockwise substantially at 90 degrees in the state in which the rotating unit 42 has reached the first and second engagement supporting portions 52*a* and 52*b*.

Figure 8:
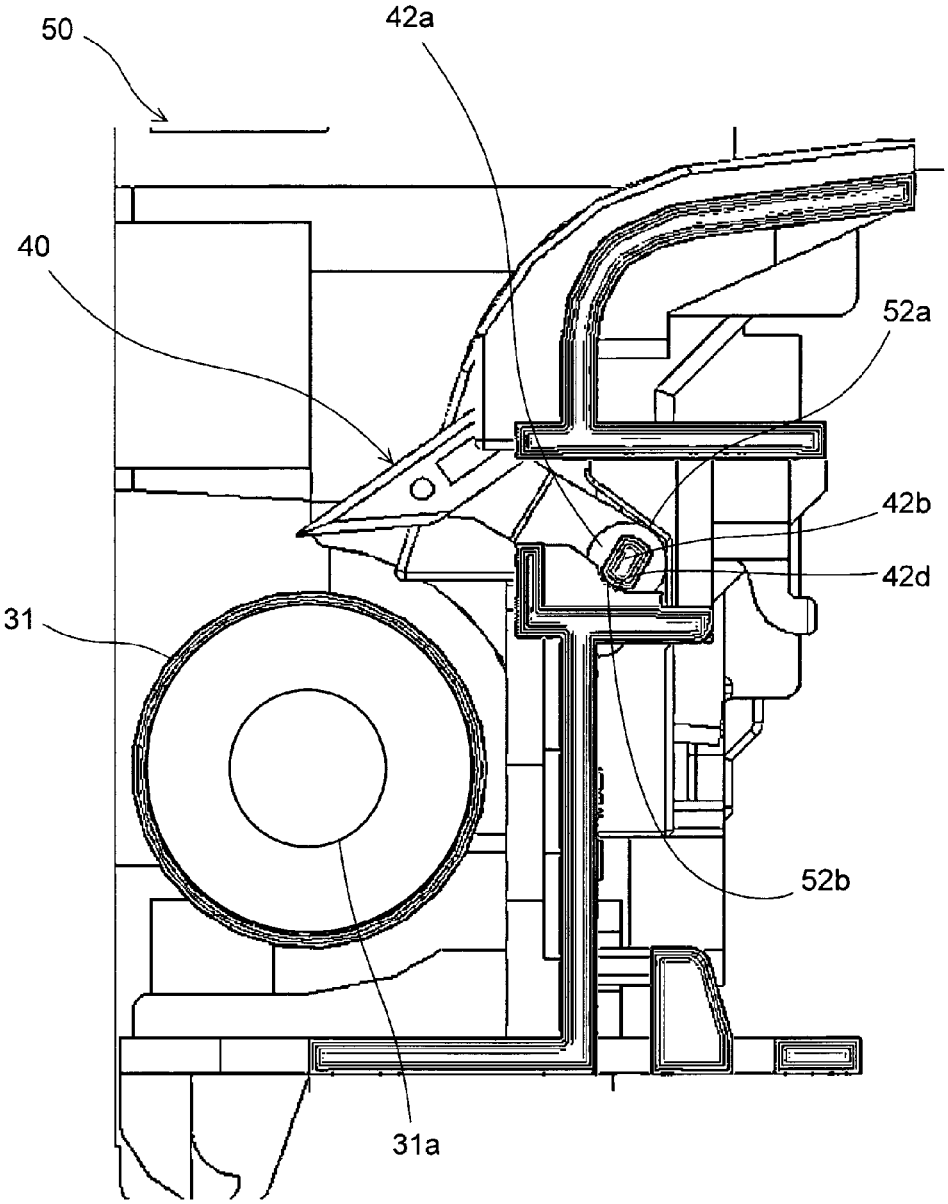
FIG. 8 is a side view showing a third process for mounting the separating member to the casing, according to an example embodiment.

In the state shown in FIG. 8, the first shaft 42*a* is supported by the first engagement supporting portions 52*a*, and the arc portions 42*d* of the second shafts 42*b* are supported by the second engagement supporting portions 52*b*. The rotation shaft 31*a* of the heating roller 31 is brought into engagement with the bearing portion of the casing 50, with the separating member 40 maintained in this state, so that the heating roller 31 is mounted to the casing 50.

Figure 9:
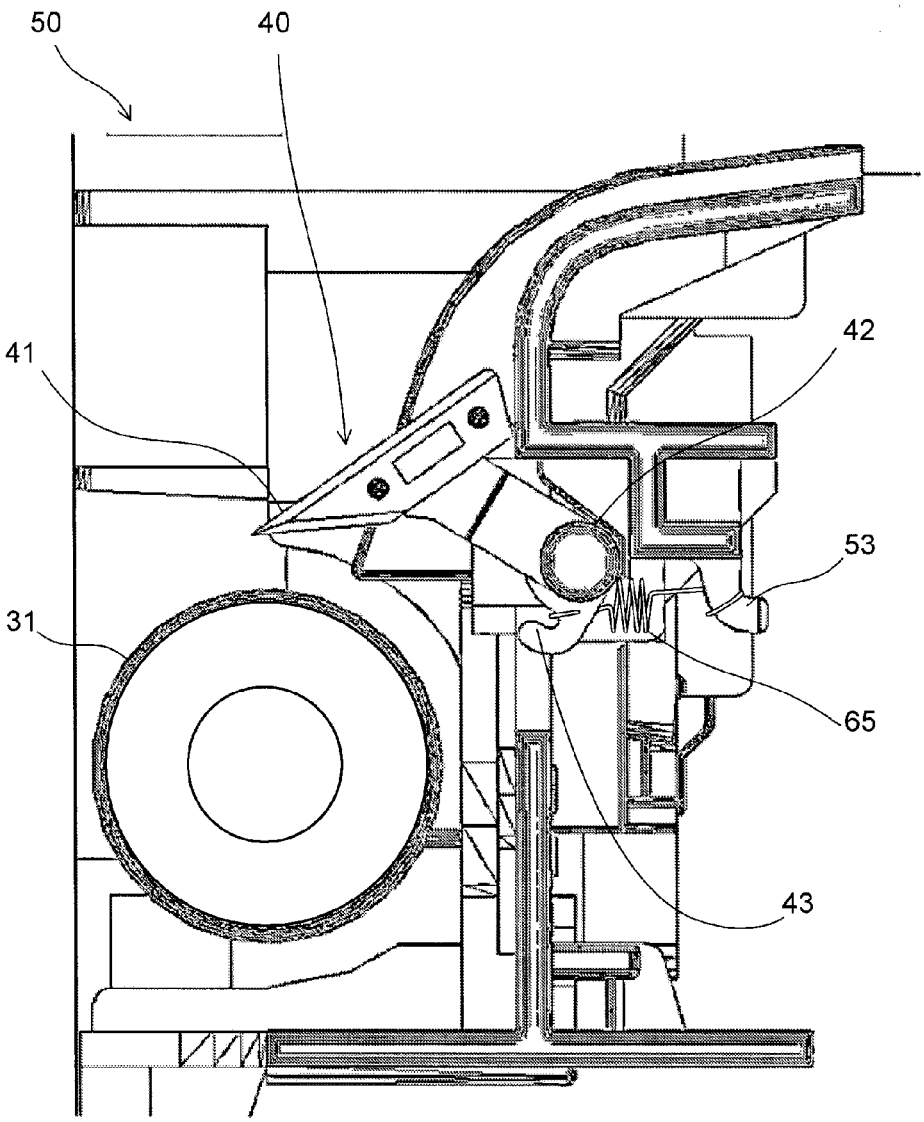
FIG. 9 is a side view showing a fourth process for mounting the separating member to the casing, according to an example embodiment.

Next, as shown in FIG. 9, to operate the spring member 65 between the separating member 40 and the casing 50, one of the hook portions of the spring member 65 is hooked on the spring hook 43 of the separating member 40, and the other hook portion of the spring member 65 is hooked on the protruding piece 53 of the casing 50. When the spring member 65 is secured to the separating member 40 and the casing 50, the contracting force of spring member 65 urges the separating member 40 to rotate counterclockwise in FIG. 9 around the rotating unit 42. Thus, the separation claw 41 comes into contact with the surface of the heating roller 31 (see FIG. 2). In some instances, the rotating unit 42 rotates counterclockwise from the state in FIG. 9 until the separation claw 41 comes into contact with the surface of the heating roller 31. The first shaft 42*a* is supported by the first engagement supporting portions 52*a*, and the arc portions 42*d* of the second shafts 42*b* are supported by the second engagement supporting portions 52*b* (the state shown in FIG. 8). Next, the pressure roller 32 (see FIG. 2) is mounted to the casing 50, and hence the assembling of the fixing unit 13 is completed. Accordingly, since the heating roller 31 restricts the counterclockwise rotation of the separating member 40, and the heating roller 31 prevents the separating member 40 from coming off. The separating member 40 can be mounted to the casing 50 with a simple configuration without providing special forms or members to the separating member 40 and/or the casing 50. It is possible to prevent the separating member 40 from dropping off during the assembly work.

Although the foregoing embodiment shows an example in which the present disclosure is applied to a roller fixing system, the present disclosure is not limited thereto and may be applied to a belt fixing system or a system in which the heating roller or the belt is heated by electromagnetic induction.

In the foregoing embodiment, although the engaging portion is constituted by part of the outer circumferential surface of the first shaft 42*a* and the arc portions 42*d* of the second shafts 42*b*, the present disclosure is not limited thereto. The rotating unit 42 may be constituted by the second shaft 42*b*, the guide surfaces may be constituted by the two flat portions 42*c* of the second shaft 42*b*, and the engaging portion may be constituted by the arc portions 42*d* and 42*e* of each second shaft 42*b*. In the case where the rotating unit 42 is configured as described above, the second engagement supporting portions 52*b* may be extended in the axial direction of the rotating unit 42 to positions facing the first engagement supporting portions 52*a* to bring the first engagement supporting portions 52*a* and the second engagement supporting portions 52*b* into engagement with the arc portions 42*d* and 42*e* of the second shafts 42*b*. Alternatively, the first engagement supporting portions 52*a* may be extended in the axial direction to the second engagement supporting portions 52*b*.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

What is claimed is:

1. A fixing unit comprising:

a heating member heated by a heat source;

a pressing member pressed against the heating member to form a nip so as to fuse an unfixed toner image on a recording medium subjected to a fixing process;

a casing that includes a supporting portion, wherein the casing rotatably supports the pressing member and the heating member;

a separating member that includes a separation claw that separates the recording medium from a surface of the heating member by making contact with the surface of the heating member;

a rotating unit that rotates the separation claw such that the separation claw makes contact with the surface of the heating member, wherein the rotating unit includes an engaging portion and guide surfaces, and wherein at least part of the engaging portion is cylindrical in shape and an interval between the guide surfaces is smaller than a diameter of the engaging portion;

an urging member including one end secured to the separating member and another end secured to the casing, wherein the urging member contracts to urge the separation claw toward the surface of the heating member;

an engagement supporting portion that rotatably engages the engaging portion; and an insertion opening extending from the guide surface toward the engaging portion the insertion opening having an interval smaller than the diameter of the engaging portion and larger than the interval between the guide surfaces, wherein the separating member is configured to rotate and rotate the guide surfaces clockwise from a position facing the casing inner wall surfaces of the insertion opening by inserting the engaging portion into the insertion opening, and wherein the guide surfaces oppose the casing inner wall surfaces of the insertion opening to move the engaging portion to the engagement supporting portion, wherein the rotating unit includes a first cylindrical shaft and a second cylindrical shaft such that the second cylindrical shaft extends from both ends of the first cylindrical shaft, wherein the second cylindrical shaft has at least one pair of opposing arc portions and at least one pair of flat portions with an interval smaller than a diameter of the first shaft, wherein when the first cylindrical shaft and the second cylindrical shaft are inserted into the insertion opening by using the flat portions as the guide surfaces: (1) the first cylindrical shaft reaches the engagement supporting portion while maintaining contact and aligning to the casing inner wall surfaces of the insertion opening, and when the heating member is mounted on the casing, (2) the separating member rotates to bring part of the outer circumferential surface of the first cylindrical shaft and one of the arc portions of the second cylindrical shaft into engagement with the engagement supporting portion, and wherein a distance between a first engaging supporting portion and a second engagement supporting portion and a distance between one of the arc portions of the second cylindrical shaft and part of the outer circumferential surface of the first cylindrical shaft corresponding to another arc portion of the second cylindrical shaft is substantially the same so that the engaging portion can rotate without making physical contact with the first engagement supporting portion and the second engagement supporting portion.

2. The fixing unit according to claim 1, wherein the separating member is one of a plurality of separating members arranged side by side in an axial direction of the heating member.

3. The fixing unit according to claim 1, wherein the separating member has a hook that is provided at the opposite side from the separation claw, and wherein the hook secures one end of the urging member.

4. The fixing unit according to claim 3, wherein the urging member has a coil spring.

5. The fixing unit according to claim 3, wherein the separation claw and the hook are located at the center of the rotating unit in the axial direction.

6. An image forming apparatus including a fixing unit, the fixing unit comprising:

a heating member heated by a heat source;

a pressing member pressed against the heating member to form a nip so as to fuse an unfixed toner image on a recording medium subjected to a fixing process;

a casing that includes a supporting portion, wherein the casing rotatably supports the pressing member and the heating member;

a separating member that includes a separation claw that separates the recording medium from a surface of the heating member by making contact with the surface of the heating member;

a rotating unit rotates the separation claw such that the separation claw makes contact with the surface of the heating member, wherein the rotating unit includes an engaging portion and guide surfaces, and wherein at least part of the engaging portion is cylindrical in shape and an interval between the guide surfaces is smaller than a diameter of the engaging portion;

an urging member including one end secured to the separating member and another end secured to the casing, wherein the urging member contracts to urge the separation claw toward the surface of the heating member;

an engagement supporting portion that rotatably engages the engaging portion; and an insertion opening extending from the guide surface toward the engaging portion;

wherein the insertion opening has an interval smaller than the diameter of the engaging portion and larger than the interval between the guide surfaces, wherein the separating member is configured to rotate and rotate the guide surfaces clockwise from a position facing the casing inner wall surfaces of the insertion opening by inserting the engaging portion into the insertion opening, and wherein the guide surfaces oppose the casing inner wall surfaces of the insertion opening to move the engaging portion to the engagement supporting portion, the rotating unit includes a first cylindrical shaft and a second cylindrical shaft such that the second cylindrical shaft extends from both ends of the first cylindrical shaft, wherein the second cylindrical shaft has at least one pair of opposing arc portions and at least one pair of flat portions with an interval smaller than a diameter of the first shaft, wherein when the first cylindrical shaft and the second cylindrical shaft are inserted into the insertion opening by using the flat portions as the guide surfaces: (1) the first cylindrical shaft reaches the engagement supporting portion while maintaining contact and with one of aligning to the casing inner wall surfaces of the insertion opening, and when the heating member is mounted on the casing, (2) the separating member rotates to bring part of the outer circumferential surface of the first cylindrical shaft and one of the arc portions of the second cylindrical shaft into engagement with the engagement supporting portion, and wherein a distance between a first engaging supporting portion and a second engagement supporting portion and a distance between one of the arc portions of the second cylindrical shaft and part of the outer circumferential surface of the first shaft corresponding to another arc portion of the second cylindrical shaft is substantially the same so that the engaging portion can rotate without making physical contact with similar to the first engagement supporting portion and the second engagement supporting portion.

7. The image forming apparatus according to claim 6, wherein the separating member is one of a plurality of separating members arranged side by side in the axial direction of the heating member.

8. The image forming apparatus according to claim 6, wherein the separating member has a hook that is provided at the opposite side from the separation claw, and wherein the hook secures one end of the urging member.

9. The image forming apparatus according to claim 8, wherein the urging member has a coil spring.

10. The image forming apparatus according to claim 8, wherein the separation claw and the hook are located at the center of the rotating unit in the axial direction.

* * * * *